United States Patent [19]

Hodil, Jr.

[11] 4,074,844

[45] Feb. 21, 1978

[54] GRAVITY FEED HOT TOP TOOL

[75] Inventor: Elmer Raleigh Hodil, Jr., Branford, Conn.

[73] Assignee: Olin Corporation, New Haven, Conn.

[21] Appl. No.: 760,059

[22] Filed: Jan. 17, 1977

[51] Int. Cl.[2] ..... B25C 1/14

[52] U.S. Cl. ..... 227/8; 227/10

[58] Field of Search ..... 227/8, 9, 10, 11

[56] References Cited

U.S. PATENT DOCUMENTS

| | | | |
|---|---|---|---|
| 3,338,496 | 3/1967 | Burtscher et al. | 227/8 |
| 3,368,730 | 2/1968 | Bayer | 227/10 |
| 3,482,753 | 12/1969 | Bayer et al. | 227/10 |
| 3,643,850 | 2/1972 | Endo et al. | 227/8 |
| 3,679,118 | 7/1972 | Maier et al. | 227/10 |
| 3,929,269 | 12/1975 | Hodil | 227/10 |

*Primary Examiner*—Granville Y. Custer, Jr.
*Attorney, Agent, or Firm*—William W. Jones; Paul J. Lerner

[57] ABSTRACT

A cartridge-type powder actuated piston tool with automatic cartridge feed by gravity and manual fastener feed. The tool is designed specifically for the setting of fasteners to secure insulating board to ingot mold walls.

18 Claims, 14 Drawing Figures

GRAVITY FEED HOT TOP TOOL

This invention relates to powder actuated fastener setting tools, and specifically to such a tool which is particularly adapted to drive fasteners through an insulation board and into an ingot mold wall so as to secure the board to the ingot mold.

Powder-actuated tools which have been specially adapted to drive fasteners through insulation board and into ingot molds are generally old in the art for securing the board to the mold. Tools of this type are formed with an elongated handle portion so that the tool can be properly positioned for the fastening operation, which is generally accomplished while the operator stands on top of the ingot mold. The general construction and mode of operation of tools of this type are shown, among others, in U.S. Pat. Nos. 3,767,099, issued Oct. 23, 1973 to Elmar Maier; and 3,679,118, issued July 25, 1972 to Elmar Maier et al.

This invention relates to such a tool which is light in weight, simple to operate and maintain, and which has an automatic, lever-operated cartridge loading capability. Additionally, provisions are made to prevent air firing of the tool, and to prevent accidental inertia-induced firing of the tool which might be the result of actuation of the operating lever. To fire the tool, the trigger must be depressed and the tool must be pressed against the workpiece. These operations can be performed in either sequence. The cartridge loading is accomplished by gravity from a loading tube.

It is, therefore, an object of this invention to provide a powder-actuated fastener setting tool which is particularly adapted to drive fasteners through an insulation board and into an ingot mold wall to secure the board to the mold.

It is a further object of this invention to provide a tool of the character described which is lever operated to automatically load cartridges into the firing chamber thereof.

It is yet another object of this invention to provide a tool of the character described wherein the cartridges are gravity fed into the firing chamber.

It is an additional object of this invention to provide a tool of the character described having a hinged housing which can be easily opened for cleaning and maintenance.

It is another object of this invention to provide a tool of the character described having provisions for preventing air firing and preventing accidental firing resulting from operating the operating lever.

These and other objects and advantages of the invention will be more readily understood from the following detailed description of a preferred embodiment thereof taken in conjunction with the accompanying drawings in which.

Figure 1:
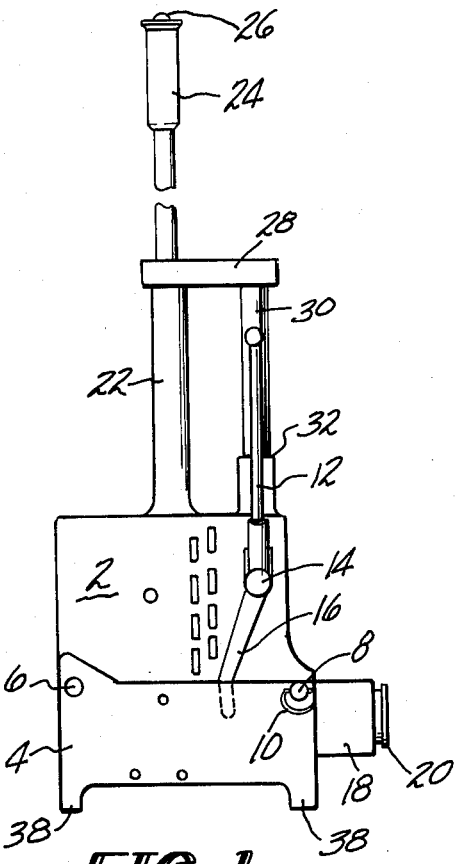
FIG. 1 is a side elevational view of a preferred embodiment of a tool formed in accordance with this invention.
Figure 2:
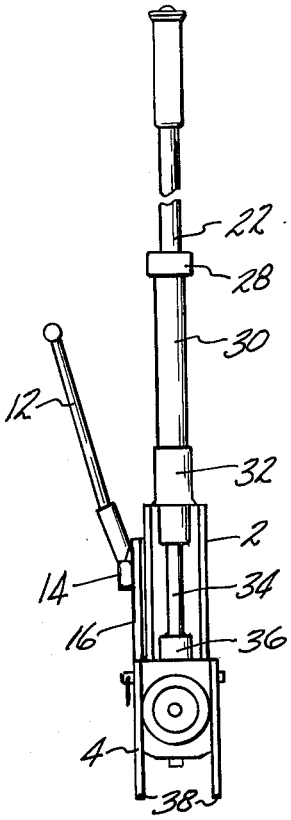
FIG. 2 is a front or muzzle end elevational view of the tool of FIG. 1.

Referring now to the drawings, the tool is shown in its entirety in FIGS. 1 and 2. The tool includes an upper housing 2 and a lower housing 4 which are hinged together about a horizontal pin 6 and which have juxtaposed open sides. A horizontal lock pin 8 extends through the upper and lower housings 2 and 4 to lock the two against pivoting about the hinge pin 6. The lock pin 8 carries a ring 10 which facilitates removal of the pin 8 so as to permit the housings 2 and 4 to be pivoted about the hinge pin 6 to open the tool. Once the tool is opened, it can be serviced, cleaned, repaired or the like. It will be understood that once the pin 8 is removed, the upper housing 2 will be free to pivot in a counter-clockwise direction about the hinge pin 6, as viewed in FIG. 1. An operating lever 12 is pivotally mounted about a bolt 14 which is secured to the upper housing 2. The operating lever 12 has a lower portion 16 which extends into the lower housing 4 for causing movement of the tool barrel, as will be described in greater detail hereinafter. The barrel guide 18 and washer guide 20 are seen projecting from the muzzle or forward end of the tool. The tool includes a trigger extension housing 22 which adapts the tool for use in the ingot mold environment. The extension housing 22 has a handle 24 fitted to the upper end thereof and protruding from the top of the handle 24 is a trigger button 26. Secured to the extension housing 22 and extending forwardly therefrom is a bracket 28. The bracket 28 is adapted to retain the upper end of a tubular cartridge magazine housing 30, the lower end of which telescopes into a boss 32 formed on the upper housing 2. The boss 32 is hollow and is aligned with a cartridge tube 34 which has a through bore sized to receive a stack of aligned cartridges. The lower end of the tube 34 is telescoped into a cartridge feed block 36. The lower housing 4 is provided with four feet 38 at its corners upon which the tool can be set.

Figure 3:
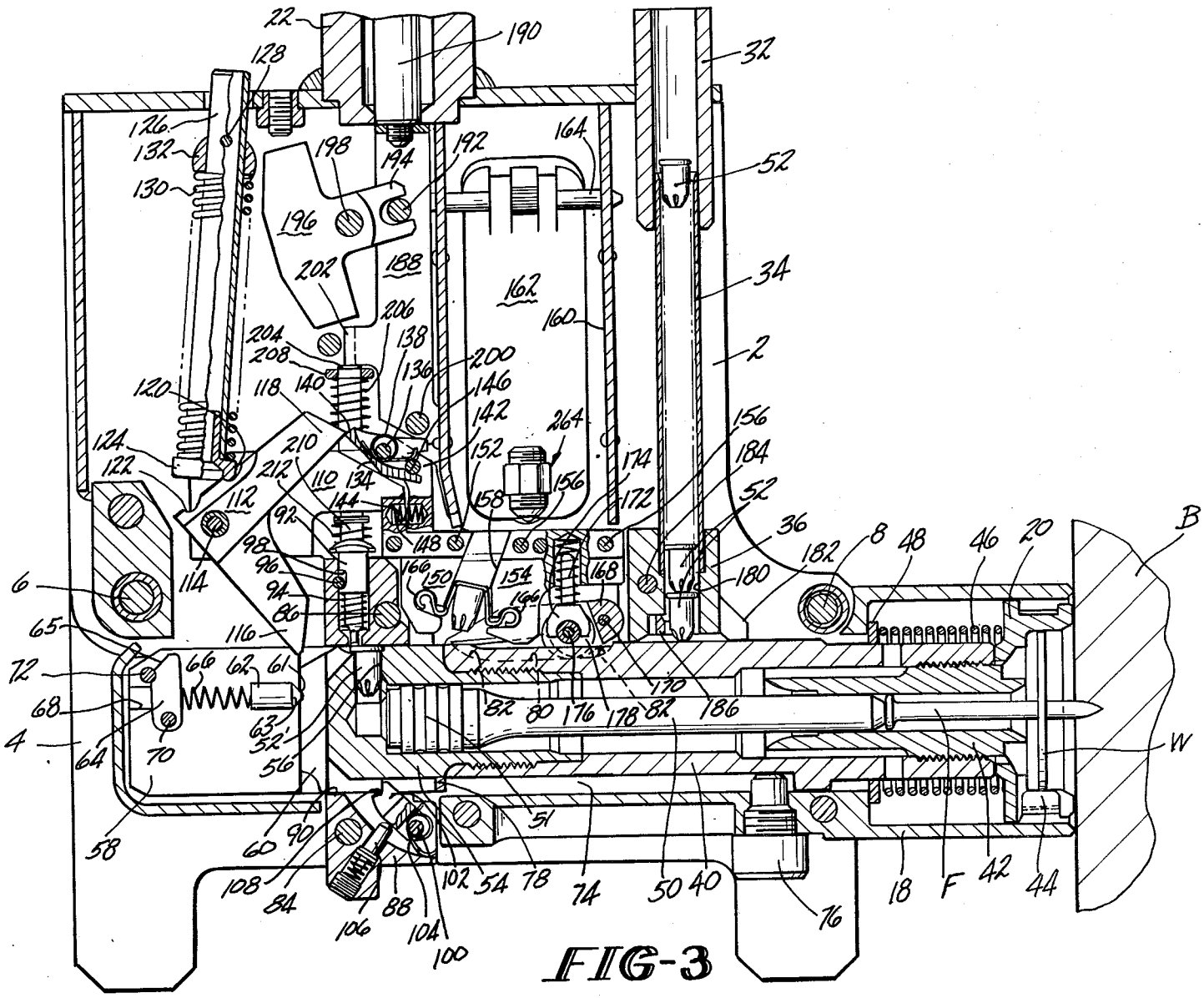
FIG. 3 is a vertical sectional view of the tool of FIG. 1 as it appears in its battery position loaded, cocked, and pressed against a workpiece for firing.

Referring now to FIG. 3, the inner construction of the tool is shown. The tool is shown in FIG. 3 as it appears in its battery position when it is pushed down against a work surface, loaded, and ready to fire. The barrel 40 is slidably mounted in the barrel support 18 for reciprocation axially thereof. Threaded into the forward end of the barrel 40 is a fastener guide 42 into which is inserted a fastener F. On the shank of the fastener F is mounted a washer W which is supported by the washer guide 20 and which is releasably retained in place by a washer detent spring 44. The washer guide 20 and barrel 40 are biased forwardly by a barrel spring 46, one end of which bears against the washer guide 20 and the other end of which bears against a ring 48 mounted in the barrel guide 18. Mounted inside of the barrel 40 is a piston or ram 50 which is driven by combustion gases from the chambered cartridge 52' to set the fastener F in the work surface. The head 51 of the piston 50 is disposed in a barrel breech member 54 which is screwed onto the back end of the barrel 40 and is movable therewith. The tool firing chamber 56 is formed in the barrel breech 54 and has a vertical axis. The rearward part of the barrel breech 54 is formed with a slot 58 in which is slidably mounted a cartridge extractor 60, the latter being mounted for vertical sliding with respect to the barrel breech 54. Also mounted in the slot 58 are an extractor detent 62, a hammer-cocking arm 64, and a spring 66 which acts on both the detent 62 and the cocking arm 64. The detent 62 and spring 66 are held in place in a horizontal groove 68 formed in the sides of the slot 58. The detent 62 has a pointed nose 63 which releasably engages a recess 61 in the rear surface of the extractor 60 by action of the spring 66. The cocking arm 64 is pivoted on a pin 70 and biased in a counter-clockwise direction against a stop pin 72. The upper rear side of the cocking arm 64 is formed with a tapered camming surface 65. The barrel 40 is formed with a longitudinally extending slot 74 in its lower surface. A take-down lug 76 is secured to the barrel guide 18 and projects into the slot 74 to permit reciprocal sliding movement of the barrel to occur with respect to the barrel guide but prevents relative rotational movement from occurring. A stop member 78 closes the rear end of the slot 74 so as to limit the extent of forward movement that the barrel 40 can undergo with respect to the barrel guide 18. A pair of parallel, longitudinally extending slots 80 are formed in the top surface of the barrel 40 with upwardly tapered ends 82.

Mounted in the lower housing 4 by means of a pair of pins 84 and 86 is a frame 88 having a through bore 90. The firing pin 92 is mounted in the upper part of the frame 88 and is biased upwardly by a firing pin spring 94. A lateral pin 96 mounted in the frame 88 extends through a notch 98 in the firing pin 92 and controls the extent of axial movement of the firing pin 92 as well as retaining it in place in the frame 88. Pivotally mounted on a laterally extending pin 100 in the frame 88 is an extractor lifter 102. The lifter 102 is biased in a counter-clockwise direction about the pin 100 by a spring 104 to the position shown in FIG. 3 wherein the lifter 102 rests against a spring biased return plunger 106. The lifter 102 is formed with a notch 108 which engages the extractor 60 as will be subsequently explained.

All of the components heretofore identified as being shown in FIG. 3 are mounted in the lower housing 4. The components described hereinafter in connection with FIG. 3 are mounted in or secured to the upper housing 2 with the exception of the lower trigger block and spring, as will be explained hereinafter. A pair of spaced, parallel trigger plates 110 are secured to the upper housing 2 and carry the major portion of the firing and ejecting sub-assemblies. The tool hammer 112 is pivotally connected to the trigger plates 110 by means of a pin 114. The hammber 112 includes a cocking foot 116 and a striking head 118. The upper surface of the hammber 112 is formed with two notches 120 and 122, one on either side of the pivotal axis of the hammber 112 as defined by the pin 114. A hammer guide 124 is telescopingly mounted in a sleeve 126 which is pivotally connected to the upper housing 2 by means of a transverse pin 128. A hammer spring 130 is mounted on the sleeve 126 with one end of the spring 130 bearing against the hammer guide 124 and the other end of the spring 130 bearing against a fixed stop 132 secured to the sleeve 126. The spring 130 thus biases the guide 124 against the hammer 112. In the cocked position of the hammer shown in FIG. 3, only the notch 120 is engaged by the guide 124, thus the hammer 112 is biased in a clockwise direction when it is cocked.

The sear 134 is pivotally mounted between the trigger plates 110 on the sear lever 142 by means of a transverse pin 136. A sear spring 138 biases the sear 134 in a counter-clockwise direction so that the hammer-engaging surface 140 on the sear 134 is properly positioned to retain the hammer 112 in its cocked position. The sear lever 142 is pivotally mounted on the trigger plates 110 for pivotal movement about the pin 146. A spring 144 biases the sear lever 142 in a counter-clockwise direction about the pin 146. It will be noted that the spring 144 is disposed in a well 148 in the back spacer 150 which is fixed to the trigger plates 110 by means of pins 152. A front spacer 154 is fixed to the trigger plates 110 by means of pins 156. The spacers 150 and 154 are offset from each other so as to form therebetween a passage 158 which extends from above the barrel 40 and opens into a cartridge casing storage chamber 160 in the upper housing 2. A door 162 is hinged to a side wall of the upper housing 2 by means of a pin 164 to provide an access to the storage chamber 160 through which cartridge casings disposed therein can be removed therefrom. The door 162 is provided with a releasable latching mechanism 264. Spring cartridge retainers 166 are mounted in recesses in the spacers 150 and 154 and extend upwardly into the passage 158.

A cartridge lifter 168 is pivotally mounted on the trigger plates 110 by means of a pin 170. A lifter spring 172 and spring guide 174 engage the hub of a cartridge lifter roller 178 which is mounted on a pin 176 secured to the lifter 168. The spring 172 and guide 174 bias the lifter 168 to the position shown in FIG. 3 wherein the rearward end of the lifter 168 rests on the top of the barrel 40. The roller 178 is biased downwardly so that it rests in the grooves 80 formed in the top surface of the barrel 40.

It will be noted that the feed block 36 includes a vertical through passage 180 into the upper enlarged end of which the cartridge tube 34 is telescoped. A stack of cartridges 52 is disposed in the tube 34 and feed block passage 180, with the nose of the lowermost cartridge in the stack resting upon the upper surface of the barrel 40. A barrel lock 182 is pivoted to the feed block 36 by means of a transverse pin 184, the lock 182 including a curved laterally extending finger 186 which is disposed rearwardly adjacent to the lowermost cartridge in the stack.

A trigger bar 188 is vertically aligned in the upper housing 2. The trigger bar 188 is secured to a trigger bar extension 190 which is slidably mounted in the extension housing 22 and on the upper end of which is formed the trigger button 26. The trigger bar 188 has fixed thereto a first lateral pin 192 which engages a clevis 194 formed at one end of an inertia weight 196. The inertia weight 196 is pivoted to the upper housing 2 on a pin 198. The purpose of the inertia weight 196 is to prevent accidental firing of the tool in the event that the operator should drop it. To achieve this feature, the mass of the trigger bar components multiplied by the distance from the trigger bar center of gravity to the inertia weight pivot must equal the mass of the inertia weight multiplied by the distance between its center of gravity to its pivot. At the lower end of the trigger bar 188 there is secured thereto a lateral pin 200, the trigger pin, which is disposed in vertical alignment with the sear 134. The trigger bar 188 also includes a rearwardly projecting extension 202 overlying the upper half of a trigger blocking system. The upper trigger block is in the form of a rod 204 which is slidably positioned in a vertical through passage (not shown) in the trigger plate 110. A spring 206 engages a nut 208 threaded onto one end of the rod 204 and engages the trigger plate 110 so as to bias the rod 204 upwardly to the position shown in FIG. 3. There is mounted in the frame 88 a lower trigger block in the form of a rod 210 which is also biased upwardly by a spring 212. The trigger blocking assembly is divided into upper and lower parts because of the manner in which the tool is opened for maintenance.

Prior to disclosing the mode of operation of the tool, reference will be made to FIGS. 8–11 which shown in perspective the various subassemblies of the tool which have already been identified.

Figure 8:
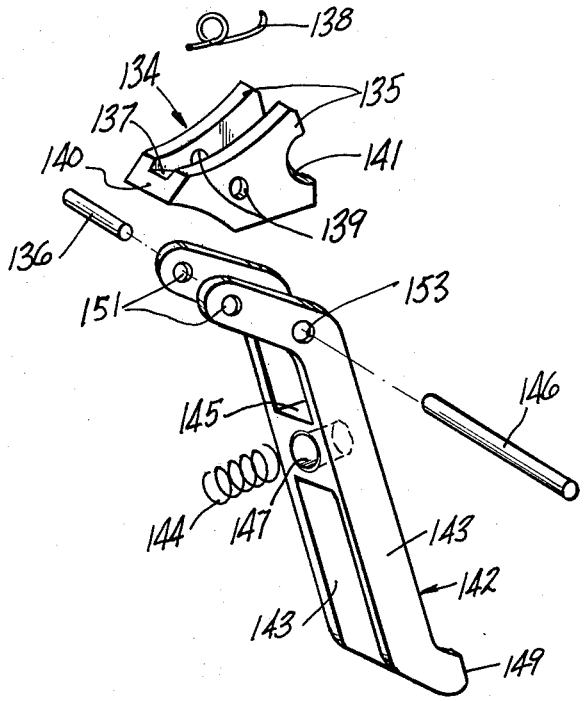
FIG. 8 is an exploded perspective view of the sear assembly.

FIG. 8 illustrates the configuration of the several components of the searing sub-assembly. It will be noted that the sear 134 is formed with two parallel upstanding side walls 135 and a transverse web 137. Holes 139 are formed in the side walls 135 to receive the pin 136, and notches 141 are formed in the edges of the side walls 135 through which the pin 146 passes. The web 137 forms a bearing surface for one end of the spring 138 and the pin 146 forms a bearing surface for the other end of the spring 138. The notches 141 are larger than the diameter of the pin 146 so that limited pivoting of the sear 134 is possible about the pin 136. The pin 146 also forms a stop for correctly positioning the sear 134 to engage the hammer. The sear lever 142 is formed with two elongated side parts 143 interconnected by a lateral web 145. A blind bore 147 is formed in the web 145 to receive one end of the spring 144. The lower end of the lever 142 is formed with a forwardly extending foot 149, the purpose of which will be set forth in greater detail hereinafter. The sear pin 136 extends through holes 151 in the lever 142 so that the sear 134 is pivotally mounted on the lever 142. The lever pin 146 extends through holes 153 so that the lever 142 is pivotally mounted on the trigger plates.

Figure 9:
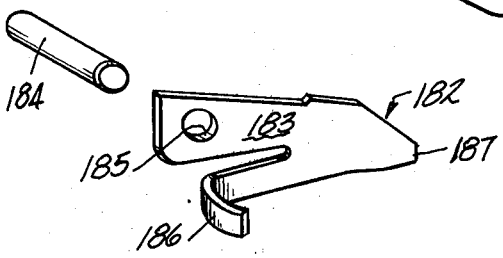
FIG. 9 is a perspective view of the barrel lock.

Referring now to FIG. 9, the barrel lock 182 is shown. The barrel lock 182 includes a main vertical portion 183 through which extends a hole 185. The barrel lock pin 184 extends through the hole 185 so that the barrel lock 182 will be pivotally mounted on the feed block. The finger 186 is arcuate and extends laterally of the vertical portion 183. The forward end of the barrel lock 182 forms a locking nose 187, the operation of which will be explained in greater detail hereinafter.

Figure 10:
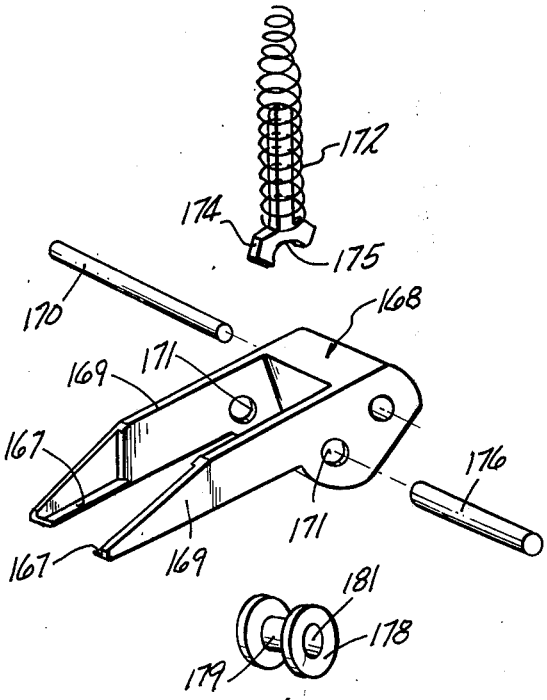
FIG. 10 is an exploded perspective view of the cartridge lifter assembly.

Referring now to FIG. 10, details of the cartridge lifter assembly are shown. The cartridge lifter 168 is formed with a pair of spaced apart fingers 169 through each of which a hole 171 is formed. The pin 176 passes through the holes 171. The roller 178 is formed with a hub 179 and a through bore 181. The pin 176 extends through the roller bore 181 and the roller 178 is journalled on the pin 176 and positioned in the space between the fingers 169. The tips of the fingers 169 are undercut at their ends to form horizontal shelves 167 which engage the rim of an extracted cartridge. It will be noted that the lifter guide 174 is formed with a lower notch 175 which engages the hub 179 of the lifter roller 178.

Figure 11:
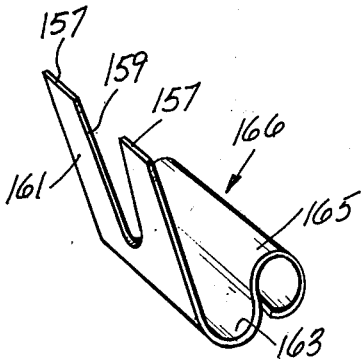
FIG. 11 is a perspective view of a cartridge retainer.

Referring now to FIG. 11, one of the cartridge retainers 166 is shown. The retainer 166 is a flat spring steel body having a terminal looped end 165 which telescopes into a through passage in the spacer in which the retainer 166 is mounted. Adjacent to the loop 165 is an upwardly curved intermediate part 163 leading to a cartridge-engaging part 161. The V-shaped recess 159 divides the part 161 into springy fingers 157 which engage and retain an extracted and ejected cartridge.

Figure 7:
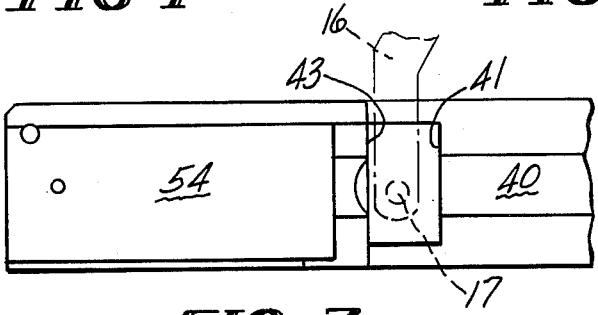
FIG. 7 is a side elevational fragmented view of the barrel and barrel breech assembly showing the connection with the operating lever.

Referring now to FIG. 7, there is shown the manner in which the lower portion 16 (shown in phantom) of the operating lever is connected to the barrel assembly of the tool. In the side surface of the barrel 40 is cut a notch 41, the rear end of which is closed by the front surface 43 of the barrel breech. The lower portion 16 of the operating lever extends down beside the notch 41 and an inwardly extending lug 17 is provided at the lowermost end of the operating lever, the lug 17 extending into the notch 41. Thus, when the operating lever is pivoted back and forth about its pivot, the barrel assembly is concurrently reciprocated. Pulling the lever handle rearward causes the barrel assembly to slide forward to its loading position, and pushing the lever handle forward causes the barrel assembly to slide rearward to its retired position.

Figure 12:
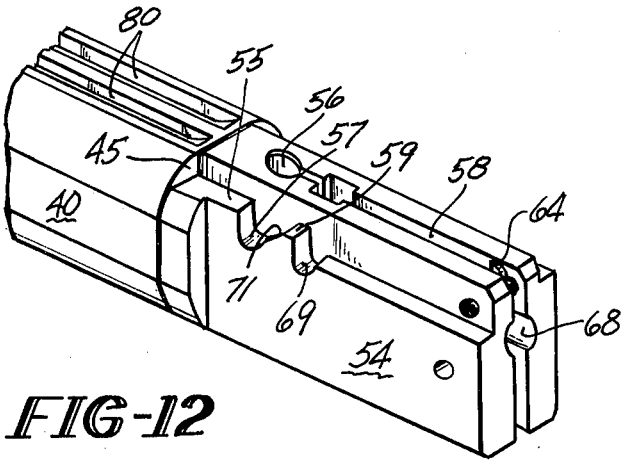
FIG. 12 is a perspective view of the barrel breech member and a portion of the barrel member to which it is secured.

Referring now to FIG. 12, a perspective view of the left-hand side of the barrel assembly rearward end portion is shown. As previously noted, the barrel breech 54 is screwed into the barrel 40. The firing chamber 56 is shown, as are the breech slot 58, and the breech groove 68. The side of the breech 54 is cut away as at 55 so that the rear face of the barrel 40 forms a rearwardly facing shoulder 45 performing several functions which will be described in detail hereinafter. The cut away 55 is formed with a first recess 57, an intervening elevated land 59, and a second recess 69, the functions of which will be described hereinafter. A ramp 71 is interposed between the first recess 57 and the land 59.

Operation of the tool will now be described. As shown in FIG. 3, the tool is in its battery or firing position. The washer guide 20 is pressed against a liner board B, which the tip of the fastener slightly enters, thereby compressing the spring 46 and sliding the barrel 40 to its battery position, wherein the firing pin 92 is properly aligned with the chambered cartridge 52'. Movement of the barrel 40 to its battery position brings the shoulder 45 (see FIG. 12) to bear against the foot 149 of the sear lever 142 thereby pivoting the latter about the pin 146 against the bias of the spring 144. This swings the sear pin 136 upward and moves the sear face 140 to the position shown in FIG. 3 wherein it is in slight engagement with the hammer 112. The tool is fired by depressing the trigger button 26 causing the trigger bar extension 190, the trigger bar 188 and the trigger pin 200 to move downwardly. The trigger pin 200 thus moves against the sear 134 pivoting the latter about the pin 136 against the bias of the spring 138 and out of engagement with the hammer 112. The hammer 112 is then free to pivot about the pin 114 under the influence of the spring 130 and guide 124. It will be appreciated that the striking head 118 of the hammber 112, in order to strike the firing pin 92, will have to swing in the clockwise direction past the horizontal. At the instant the striking head 118 is in the horizontal position, the guide 124 will engage both hammer notches 120 and 122. After the striking head 118 has passed the horizontal, only the notch 122 will be engaged by the guide 124. Momentum will carry the hammer 112 past the horizontal and cause the striking head 118 to impact the firing pin 92. After the clockwise momentum of the hammer 112 is dissipated on the firing pin 92, the guide's engagement with the hammer notch 122, which is to the rear of the pivot pin 114, will, by means of the hammer spring 130, cause the hammer 112 to pivot about the pin 114 in a counter-clockwise direction until both notches 120 and 122 are engaged by the guide 124 at which time the striking head 118 will be horizontal and upwardly offset from and out of contact with the firing pin 92. Thus the firing pin spring 94 will be able to return the firing pin 92 to its ready position after the chambered cartridge 52′ is fired.

Figure 13:
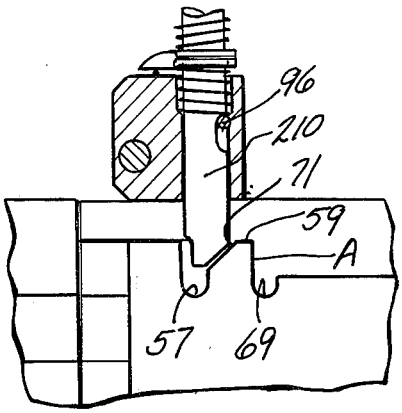
FIG. 13 is a side elevational view, fragmented, of the lower trigger block assembly.

If desired, the tool may be fired by first depressing the trigger button 26, causing the rod 210 to move against surface 59 on the barrel breech 54. When the muzzle is then pressed against the work, the sear lever 142 is pivoted, swinging the sear pin 136 upward. Full sear release is accomplished by simultaneous movement of the sear lever 142 and the rod 210. Final relation of the rod 210 and barrel breech 54 is shown in FIG. 13. Due to the displacement of the sear pin 136, the movement of the sear lever 142 causes the hammber 112 to disengage from the sear 134, whereupon it is free to fall.

Figure 4:
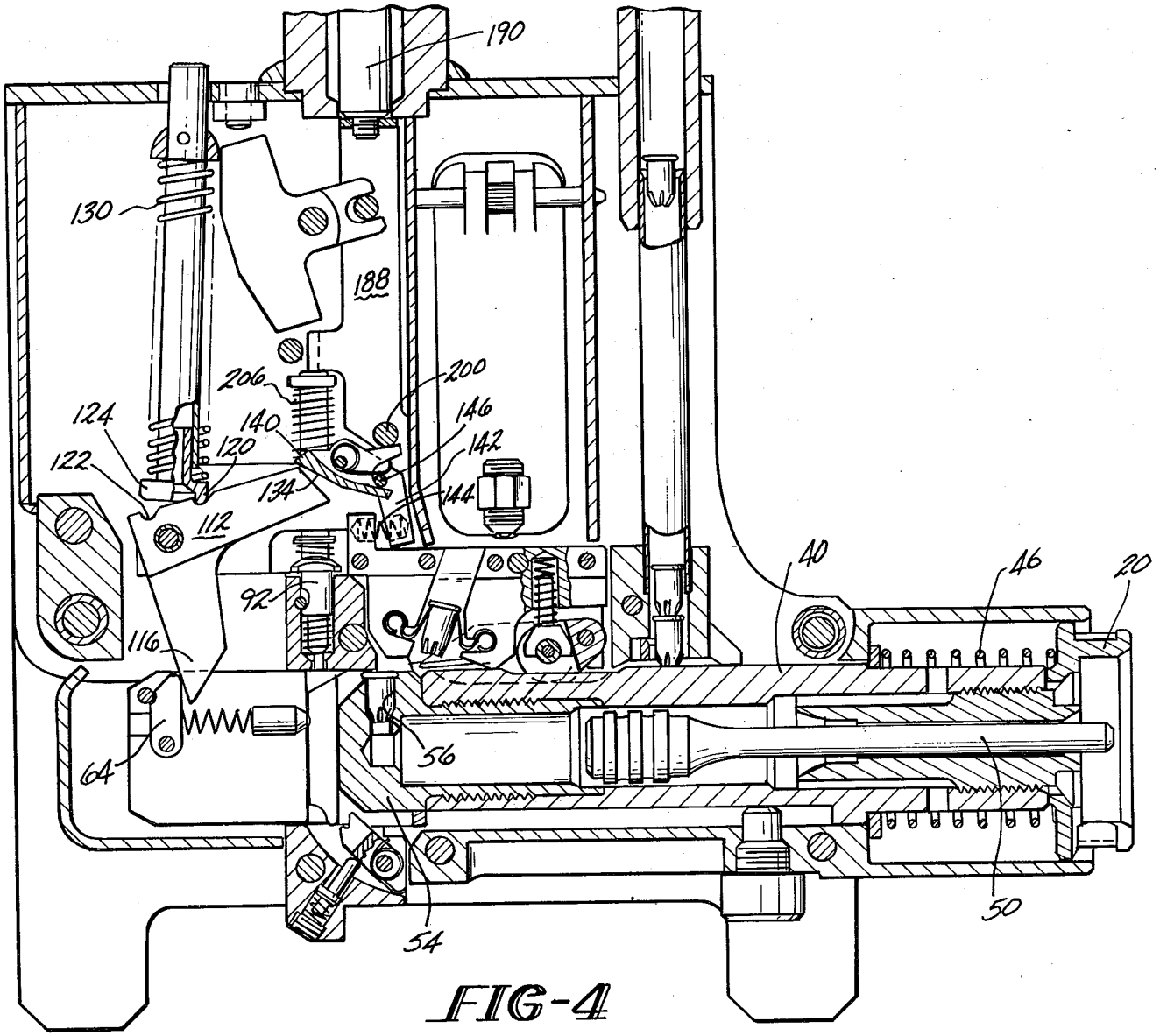
FIG. 4 is a sectional view similar to FIG. 3, but showing the tool in its retired position after it has been fired and released from pressing against the workpiece.

After the tool has been fired, it is withdrawn from the liner board and the tool components take the respective retired positions shown in FIG. 4. The piston 50 is driven to its fired position, shown in FIG. 4, and the spring 46 expands to its equilibrium position, pushing the washer guide forward to the position shown in FIG. 4. The barrel 40 is thus pulled forward along with the breech 54. In the position shown in FIG. 4, the firing chamber 56 is out of alignment with the firing pin 92 so the tool cannot be fired. Additionally, the barrel shoulder 45 (see FIG. 12) is moved forward away from the sear lever foot 149 (see FIG. 8) and the lever spring 144 pivots the sear lever 142 about the pin 146 to the position shown in FIG. 4. This pivotal movement of the sear lever 142 causes the sear 134 and its hammer-engaging face 140 to move downward slightly in the tool. At the same time, the hammer cocking arm 64 moves forward to engage the cocking foot 116 of the hammer 122 to begin cocking the hammer.

Figure 6:
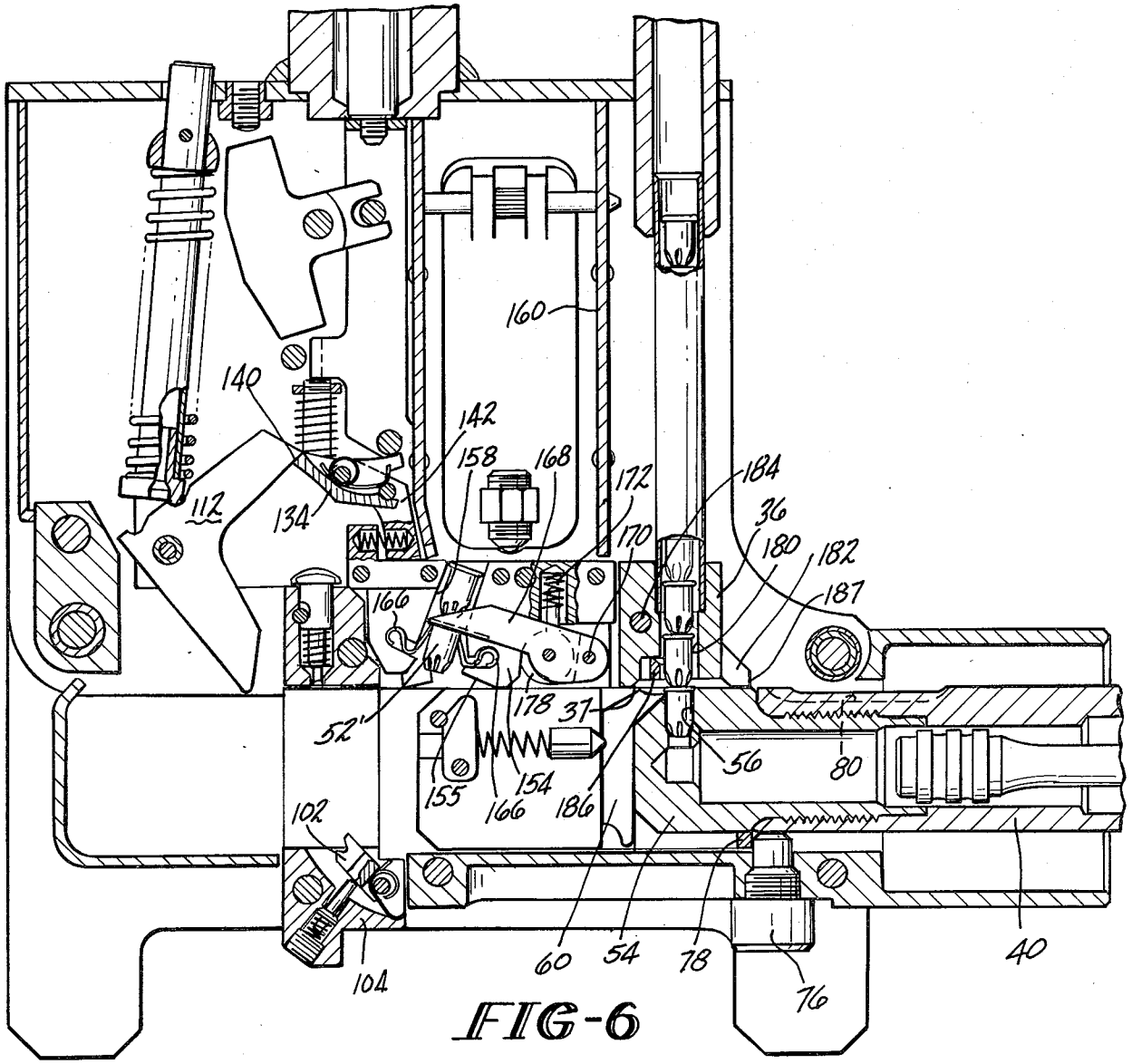
FIG. 6 is a sectional view similar to FIG. 5, but showing operation of the tool in its loading position wherein the spent cartridge is ejected into the storage passage and a fresh cartridge is chambered in the firing chamber.

The operating lever 12 is then pivoted in a counter-clockwise direction about the bolt 14 to the fullest possible extent to cause further forward sliding movement of the barrel 40 and breech 54 which continues until the lug 76 contacts the stop member 78, as shown in FIG. 6.

Figure 5:
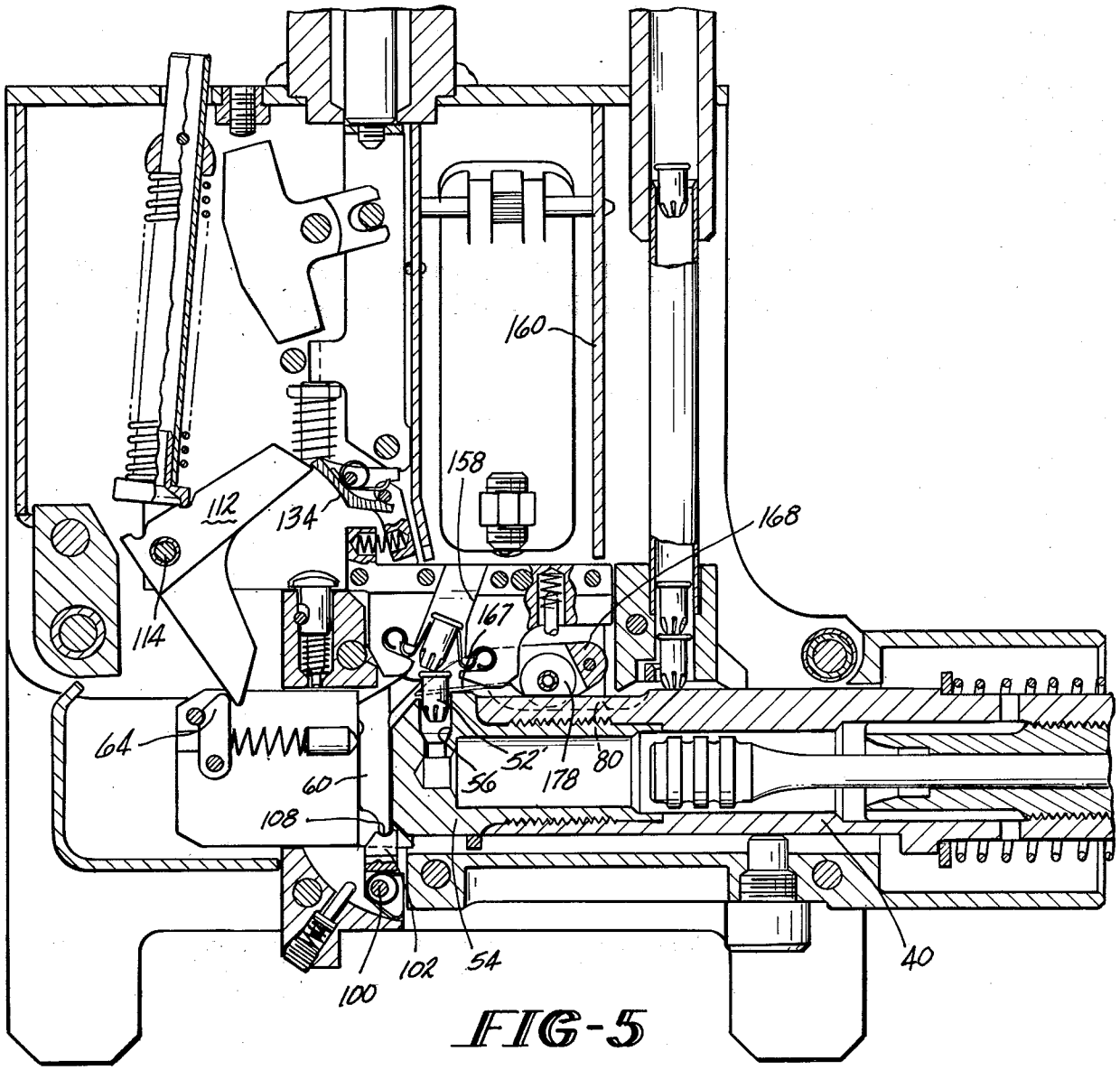
FIG. 5 is a sectional view similar to FIG. 4, but showing operation of the tool to extract the spent cartridge from the firing chamber.

Referring to FIG. 5, an intermediate position is depicted in the forward sliding action of the barrel 40 and breech 54. When the barrel and breech reach the position shown in FIG. 5, the cocking arm 64 will have pivoted the hammer 112 about the pin 114 to a position wherein the hammer 112 is almost fully cocked and almost engaged by the sear 134. The extractor 60 will have been moved forward into engagement with the extractor lifter notch 108 sufficiently to cause the extractor lifter 102 to pivot clockwise about the pin 100 causing the extractor 60 to slide upwardly in the breech 54 and push the fired cartridge case 52′ part way out of the firing chamber 56. The extracted case 52′, at this point, overlies the shelves 167 on the cartridge lifter 168. The extracted cartridge case 52′ has begun to enter the passage 158 and has pushed the cartridge case already therein upward somewhat toward the storage chamber 160. The cartridge lifter roller 178 is still in the barrel grooves 80 but nearing the rearward end thereof.

Referring now to FIG. 6, the forwardmost loading position of the barrel 40 and breech 54 is shown. In is noted that forward movement of the barrel and breech is stopped by engagement of the lug 76 with the stop member 78. At this point the firing chamber 56 is coaxial with the feed block passage 180 and the lowermost cartridge in the stack drops into the firing chamber 56 under the influence of gravity. The cartridge lifter roller 178 has left the barrel grooves 80 and is now on the upper surface of the breech 54. The cartridge lifter 168 is thus pivoted in a clockwise direction about the pin 170, compressing the spring 172. The fired cartridge 52′ is lifted in the passage 158 sufficiently to cause the cartridge rim to engage the cartridge retainers 166. The fired cartridge 52′ is thus prevented from falling back downward toward the breech 54. The other fired cartridge is thus pushed upward through the passage 158 toward the storage chamber 160. The extractor 60 has been cammed back down to its initial position by a cam surface 155 on the front spacer 154. The extractor lifter 102 has been pivoted back to its initial position by the spring 104. The hammer 112 has been completely cocked and fully engages the sear 134. A comparison of FIGS. 3 and 6 will show that the extent of contact between the hammer 112 and the face 140 on the sear 134 is greater in FIG. 6 than it is in FIG. 3. This is because the sear lever 142 is pivoted forward in FIG. 6, while it is pivoted rearward in FIG. 3. It will also be appreciated that the junction between the barrel 40 and the breech 54 is forward of the feed block 36. Thus the rear surface 45 of the barrel 40 (see FIG. 12) is forward of the nose 187 of the barrel lock 182. It will be noted that the finger 186 on the barrel lock 182 is rearwardly adjacent to the cartridge stack. If the lowermost cartridge in the stack is not fully chambered by reason of fouling, or the like, a cam surface 37 on the feed block 36 will push the cartridge down snugly into the chamber 56 as the barrel 40 is returned to its rearward position. In the event that the lowermost cartridge projects too far out of the chamber 56 to engage the cam surface 37, it will be pushed against the barrel lock finger 186 as the barrel is pushed back to its rearward position. This will cause the barrel lock 182 to pivot in a clockwise direction about the pin 184 swinging the nose 187 down into engagement with the rear surface 45 on the barrel 40, thus stopping further rearward closing movement of the barrel and breech. This safety feature will prevent jamming of the tool or premature firing of the cartridge. It will also indicate to the operator possible fouling of the firing chamber. This feature will also prevent closing of the tool in the event that a long cartridge is accidently included in the cartridge stack. The tool is readied for firing, once a new cartridge is chambered, by actuating the operating lever 12 to push the barrel 40 and breech 54 back to the retired position shown in FIG. 4. The piston 50 is returned to its firing position by inserting a new fastener and washer into the muzzle end of the tool.

It has been noted that once the tool has been loaded, a fastener inserted, and the tool returned to the retired position shown in FIG. 4, it can be fired by pressing the muzzle against the work surface and depressing the trigger button, in either order. The tool cannot be fired, however, by depressing the trigger button when the tool is in the position shown in FIG. 6, inserting a fastener, and then returning the tool to the position shown in FIG. 3 by means of inertia. The reason that this is not possible is that depression of the trigger button will result in depression of the lower trigger block 210 to the position shown in FIG. 13, whereby subsequent movement of the barrel and breech will cause the depressed trigger block 210 to engage the breech surface A (see FIG. 13) thereby preventing further rearward movement of the barrel and breech. Thus the firing chamber 56 will not be returned to its rearward position and the firing pin 92 will not align with the rim of the chambered cartridge. Thus the cartridge cannot be fired by the hammer and firing pin.

Figure 14:
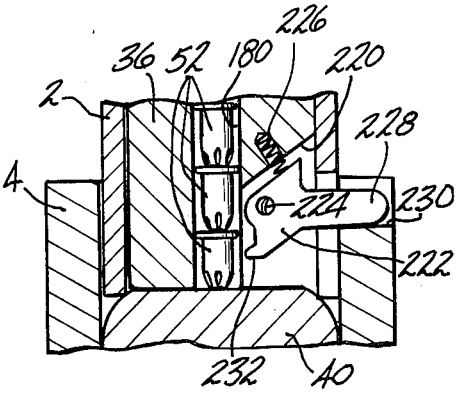
FIG. 14 is a lateral sectional view of the feed block area of the tool wherein the cartridge retainer is mounted.

Referring now to FIG. 14, a cartridge stop assembly is shown for preventing the cartridge stack from falling out of the feed block when the tool is opened by pivoting the upper housing away from the lower housing. The stack is cartridges 52 is shown in the passage 180 in the feed block 36, the lowermost cartridge resting upon the upper surface of the barrel 40. The upper and lower housings 2 and 4 respectively are shown. A lateral slot 220 is cut in the feed block 36 and in the slot is pivotally mounted a cartridge stop 222 on a pin 224. The stop 222 is biased in a counter-clockwise direction by a compressed spring 226 so that an arm 228 is biased against the wall 230 of a notch cut in the lower housing 4. The stop 222 also includes a finger 232 which is disposed out of contact with the cartridges 52 in the stack when the tool is closed, as shown in FIG. 14. When the tool is opened, the lower housing 4 and barrel 40 move away from the remainder of the structure shown in FIG. 14, thus the spring 226 pivots the stop 222 in a clockwise direction moving the finger 232 to a position where it engages the rim of the lowermost cartridge in the stack preventing it from falling from the passage 180. Thus the entire cartridge stack is held in place when the tool is opened. When the tool is again closed, the stop 222 is again returned to the position shown in FIG. 14 and the cartridges are free to feed into the firing chamber.

To briefly recap the mode of operation of the tool, after firing, a new fastener and washer are inserted into the muzzle end of the tool pushing the piston back to its rearward position. The fastener and washer are retained in place by the spring clip engaging the washer. The operating lever is then pushed rearwardly causing the barrel assembly to move forward. During forward movement of the barrel assembly, the hammer is recocked, the fired cartridge case is extracted, the extracted cast is lifted into engagement with the retainer springs and out of the firing chamber and away from the barrel assembly, the extractor is cammed down by the forward spacer ramp, the barrel stops its forward movement, and a fresh cartridge drops into the firing chamber under the influence of gravity. The operating lever is then pushed forwardly to its initial position causing the barrel assembly to return to its rearward retired position. During this rearward return movement of the barrel assembly, the cartridge lifter returns to a horizontal position by spring action, the cocking lever snaps over the hammer spur, the extractor snaps over the extractor lifter, and the barrel assembly then stops on the barrel spring washer leaving an additional small travel distance for push down which is required before the tool can be fired. During push down, the barrel assembly travels rearward so that the chambered cartridge properly lines up with the firing pin, the sear lever pivots to begin disengagement of the sear from the hammer, and the lower trigger block is properly aligned for actuation with respect to the barrel assembly. The trigger button is then depressed causing the trigger bar to move downwardly. The counterweight is rotated in a clockwise direction until it contacts the adjustment screw, which is provided to adjust the extent of trigger bar motion to ensure proper sear release. The upper and lower trigger blocks move down against the action of their respective springs, the trigger blocks springs providing the main component of trigger pull for the tool. The sear is then rotated to disengage from the hammer which is then pivoted in a clockwise direction by the hammer spring to strike the firing pin. The hammer spring and guide then position the hammer in a pivotal position offset from the firing pin so that the latter can rebound away from the fired cartridge by means of the firing pin spring. Gases generated by the cartridge drive the piston in a conventional manner and can be vented in passages through a barrel and fastener guide, or through clearance between the piston shank and fastener guide bore, or both. The tool can be fired by push down on the barrel followed by depressing of the trigger button, or in the reverse sequence.

The tool can be opened to gain access to its interior by removing the lock pin and pivoting the upper housing away from the lower housing. The pivot pin is at the rear of the tool. This opening pivotal motion disengages the operating lever from the barrel assembly and exposes the basic parts of the tool for clearing, or minor cleaning and repair. The barrel assembly can be removed by withdrawing the barrel stop lug from the barrel slot and pulling the barrel assembly forward out of the barrel guide.

Since many changes and variations of the disclosed embodiment of the invention may be made without departing from the inventive concept, it is not intended to limit the invention otherwise than as required by the appended claims.

What is claimed is:

1. A powder-actuated tool comprising:

a. a housing;

b. a barrel assembly mounted in said housing for reciprocal sliding movement with respect to said housing from a rearwardmost battery position to a forward loading position and return;

c. means forming a firing chamber in said barrel assembly, said firing chamber having a substantially vertical axis;

d. means carried by said housing forming a substantially vertical passage adapted to receive and hold a stack of a plurality of cartridges disposed end to end in said passage, said passage being positioned forward of said firing chamber when said barrel assembly is in its battery position; and e. stop means on said housing for stopping forward movement of said barrel assembly to align said firing chamber and said passage to enable a cartridge to drop by gravity from said gravity into said firing chamber when said barrel assembly is in said loading position.

2. The tool of claim 1, further comprising an extractor carried by said barrel assembly, and extractor actuating means operable during forward movement of said barrel assembly to cause said extractor to extract a fired cartridge from said firing chamber.

3. The tool of claim 1, further comprising cartridge lifter means on said housing for engaging and lifting a fired cartridge free of said barrel assembly, said lifter means being disposed forward on said firing chamber when said barrel assembly is in said battery position; and lifter actuating means on said barrel assembly for actuating said lifter when said barrel assembly is moved from said battery position to said loading position.

4. The tool of claim 1, wherein said barrel assembly includes an upper surface operable to prevent cartridges from discharging from said vertical passage when said barrel assembly is offset from said forward loading position.

5. The tool of claim 1, further comprising barrel assembly locking means mounted on said housing adjacent to said vertical passage, said locking means being operable to engage a surface on said barrel assembly to stop rearward movement of the latter from said loading position in the event that a newly chambered cartridge projects upwardly beyond an upper surface of said barrel assembly a predetermined distance thereby indicating an improper chambering condition.

6. The tool of claim 1, further comprising an elongated tubular member secured to said housing and extending therefrom at right angles to the direction of movement of said barrel assembly to provide means for positioning the tool below the feet of a standing operator, said tubular member having an upper end portion adapted to be grasped and held in an operator's hands; an elongated trigger bar assembly slidably disposed within said tubular member and extending into said tool housing; means connected to said trigger bar assembly for enabling sliding movement thereof with respect to said tubular member to be accomplished manually by the operator; a hammer mounted in said housing; searing means mounted in said housing for releasably engaging said hammer in a cocked position; and said trigger bar assembly having a lower portion thereof engageable with said searing means to disengage the latter from said hammer when said trigger bar assembly is slid within said tubular member to a firing position.

7. The tool of claim 6, wherein said trigger bar assembly includes blocking means for engaging a surface on said barrel assembly to block rearward movement of said barrel assembly toward said battery position upon sliding of said trigger bar assembly to said firing position before said barrel assembly has reached a rearward retired position thereby preventing accidental inertial firing of the tool.

8. The tool of claim 1, further comprising a hammer mounted in said housing; a sear lever pivotally mounted in said housing, said sear lever being pivotable between a first position and a second position, said sear lever having a portion thereof disposed for engagement with a surface on said barrel assembly forming means for pivoting said sear lever from said first position to said second position when said barrel assembly is moved rearward to said battery position; sear means mounted on said sear lever for engagement with said hammer to hold the latter in a cocked position, said sear means providing a maximum degree of engagement with said hammer when said sear lever is in said first position, and a minimum degree of engagement with said hammer when said sear lever is in said second position; and trigger means manually operable to disengage said sear means from said hammer only when said sear lever is in said second position.

9. The tool of claim 1, wherein said housing comprises upper and lower housing parts which are pivotally hinged together to facilitate opening the tool for cleaning and repair; said upper and lower housing parts meeting along a parting line which is generally parallel to the direction of movement of said barrel assembly, said barrel assembly being disposed in said lower housing part and said vertical passage being disposed in said upper housing part; releasable means for holding said upper and lower housing parts agaist each other and in a closed position; and firing means disposed in said upper housing for manual operation to ignite a chambered cartridge to operate the tool.

10. The tool of claim 9, further comprising cartridge restraining means mounted on said upper housing part adjacent to said vertical passage for engaging the lowermost cartridge in said vertical passage when said upper housing part is pivoted away from said lower housing part to restrain the cartridge stack against falling out of said vertical passage; and means on said lower housing part for preventing said restraining means from engaging cartridges in the stack when said upper and lower housing parts are in said closed position.

11. The tool of claim 1, further comprising operating lever means pivotally mounted on said housing and engaging said barrel assembly for moving said barrel assembly between a retired position and said loading position and return, said operating lever means including a part projecting outwardly of said housing for manual manipulation of said operating lever means.

12. A powder-actuated tool adapted for firing cased cartridges, said tool comprising:

a. a housing;

b. a barrel assembly in said housing, said barrel assembly and said housing being interconnected for relative reciprocal rectilinear movement therebetween wherein said barrel assembly is in a battery position at one end of said rectilinear movement, and a loading position at another point in said rectilinear movement;

c. a firing chamber in said barrel assembly for reception of cartridges to be fired, said firing chamber having an axis which is substantially perpendicular to the direction of the rectilinear movement;

d. cartridge extractor means for extraction of a fired cartridge case from said firing chamber;

e. cartridge lifter means for lifting an extracted cartridge case away from said barrel assembly;

f. first actuating means for actuating said extractor means at a first occurring predetermined point in a first phase of the reciprocal rectilinear movement; and g. second actuating means for actuating said cartridge lifter means at a second occurring predetermined point in the first phase of the reciprocal rectilinear movement to clear the firing chamber to receive a fresh cartridge at the end of the first phase of the reciprocal rectilinear movement.

13. The tool of claim 12 wherein said housing includes a passage for the reception of fired cartridge cases; and means projecting into said passage to engage and prevent return movement of a cartridge case moved thereto by said cartridge lifter means.

14. A power-actuated tool comprising:

a. a first housing part;

b. a barrel assembly mounted in said first housing part for reciprocal rectilinear movement in the direction of the axis of said barrel assembly between first and second positions;

c. means biasing said barrel assembly toward said first position;

d. means forming a firing chamber for receiving a powder charge in said barrel assembly, said firing chamber having an axis which is perpendicular to the barrel assembly axis and said firing chamber opening through a side wall of said barrel assembly for loading of a powder charge therein;

e. a second housing part;

f. means forming a charge firing assembly mounted in said second housing part for firing a powder charge disposed in said firing chamber, said firing means being operable only when said barrel assembly is in said second position;

g. elongated means forming a handle secured to said second housing part and extending therefrom in a direction perpendicular to the barrel assembly axis for providing means for positioning the first and second housing parts beneath the feet of a standing operator;

h. means connecting said first and second housing parts together for relative pivotal movement with respect to each other between open and closed positions whereby the side wall of the barrel assembly and firing chamber will be exposed along with the firing assembly for purposes of maintenance and cleaning when said housing parts are pivoted to said open position; and i. means for releasably holding said first and second housing parts in said closed position.

15. A powder-actuated tool comprising:

a. a housing divided into upper and lower parts pivotally connected together, each of said housing parts having an open side, with said respective open sides being juxtaposed along a parting line so that the housing may be opened by pivoting said lower housing part away from said upper housing part;

b. a barrel assembly slidably disposed in said lower housing part for reciprocal movement between a battery position and a loading position, said barrel assembly including a firing chamber opening through an upper surface on said barrel assembly, said firing chamber having a vertical axis;

c. means carried by said upper housing part forming a substantially vertical passage adapted to receive and hold a stack of a plurality of cartridges disposed end to end in said passage, said passage being positioned along the path of movement of said barrel assembly so that said passage is coaxial with said firing chamber when said barrel assembly is in said loading position, said vertical passage having an open lower end adjacent to an upper surface of said barrel assembly which barrel assembly upper surface contacts the lowermost cartridge in the stack thereof in said passage to retain the entire stack in said passage when the tool is closed;

d. cartridge restraining means mounted on said upper housing part adjacent to said vertical passage for engaging the lowermost cartridge in said vertical passage when the tool is opened by pivoting said lower housing part away from said upper housing part thereby restraining the cartridge stack against falling out of said vertical passage; and e. means on said lower housing part for preventing said restraining means from engaging cartridges in the stack when the tool is closed.

16. A powder-actuated tool comprising:

a. a housing;

b. a barrel assembly mounted in said housing for reciprocal movement with respect to said housing between a battery position and a loading position, and return;

c. a firing chamber disposed in said barrel assembly;

d. cartridge feed means mounted on said housing for feeding individual cartridges into said firing chamber when said barrel assembly is in said loading position, said cartridge feed means being offset from said firing chamber when said barrel assembly is in said battery position; and e. barrel assembly blocking means secured to one of said housing and said barrel assembly, and operable to sense an improperly chambered cartridge adjacent to said cartridge feed means, said blocking means further being operable, upon sensing an improperly chambered cartridge, to prevent said barrel assembly from returning from said loading position to said battery position.

17. A power-actuated tool comprising:

a. a housing;

b. a barrel assembly mounted in said housing for reciprocal movement with respect to said housing between a battery position and a loading position, and return;

c. cartridge firing means mounted in said housing operable to fire a chambered cartridge to operate the tool only when said barrel assembly is in said battery position, said cartridge firing means including a trigger assembly which must be manually actuated to operate said cartridge firing means; and d. trigger block means mounted on said housing and operably connected to said trigger assembly for blocking movement of said barrel assembly to said battery position when said trigger assembly is actuated before said barrel assembly is returned from said loading position to a retired position interposed between said loading position and said battery position, whereby the tool cannot be inertially fired.

18. A powder-actuated tool comprising:

a. a housing;

b. a barrel assembly mounted in said housing for reciprocal movement with respect to said housing between a battery position and a loading position;

c. means forming a firing chamber in said barrel assembly;

d. firing means in said housing, said firing means including a hammer;

e. a sear lever mounted in said housing for pivotal movement between a first position and a second position and return, said sear lever being biased toward said second position, and said sear lever including a means thereon positioned for engagement with a surface on said barrel assembly to pivot said sear lever to said first position only when said barrel assembly is moved to said battery position;

f. sear means pivotally mounted on said sear lever for engagement with said hammer to retain the latter in a cocked position, said sear means providing a maximum extent of engagement with said hammer when said sear lever is in said second position, and a minimum extent of engageable with said hammer when said sear lever is in said first position; and g. trigger means mounted on said housing for manual actuation to disengage said sear means from said hammer only when said sear means is in minimum engagement with said hammer.

* * * * *

UNITED STATES PATENT OFFICE

CERTIFICATE OF CORRECTION

Patent No. 4,074,844 Dated February 21, 1978

Inventor(s) Elmer Raleigh Hodil, Jr.

It is certified that error appears in the above-identified patent and that said Letters Patent are hereby corrected as shown below:

Col. 3, line 67: the word "hammber" should read --hammer--.

Col. 4, line 1: the word "hammber" should read --hammer--.

Col. 4, line 2: the word "hammber" should read --hammer--.

Col. 6, line 68: the word "hammber" should read --hammer--.

Col. 7, line 30: the word "hammber" should read --hammer--.

Col. 9, line 21: the word "is", first occurence, should read --of--.

Col. 9, line 25: the word "the", second occurence, should read --that--.

UNITED STATES PATENT OFFICE
CERTIFICATE OF CORRECTION

Patent No. 4,074,844 Dated Feb. 21, 1978

Inventor(s) Elmer Raleigh Hodil, Jr.

It is certified that error appears in the above-identified patent and that said Letters Patent are hereby corrected as shown below:

Col. 10, line 61: the word "gravity", second occurence, should read --passage--.

Col. 12, line 10: the word "agaist" should read --against--.

Col. 14, line 62: the word "engageable" should read --engagement--.

Signed and Sealed this

*Twenty-fifth* Day of *November 1980*

[SEAL]

*Attest:*

SIDNEY A. DIAMOND

*Attesting Officer* *Commissioner of Patents and Trademarks*